US007635292B2

(12) United States Patent
Togawa et al.

(10) Patent No.: US 7,635,292 B2
(45) Date of Patent: Dec. 22, 2009

(54) SUBSTRATE HOLDING DEVICE AND POLISHING APPARATUS

(75) Inventors: Tetsuji Togawa, Tokyo (JP); Hiroshi Yoshida, Tokyo (JP); Osamu Nabeya, Tokyo (JP); Makoto Fukushima, Tokyo (JP); Koichi Fukaya, Tokyo (JP)

(73) Assignee: Ebara Corporation, Tokyo (JP)

( * ) Notice: Subject to any disclaimer, the term of this patent is extended or adjusted under 35 U.S.C. 154(b) by 2 days.

(21) Appl. No.: 11/791,218

(22) PCT Filed: Dec. 6, 2005

(86) PCT No.: PCT/JP2005/022735

§ 371 (c)(1),
(2), (4) Date: May 22, 2007

(87) PCT Pub. No.: WO2006/062232

PCT Pub. Date: Jun. 15, 2006

(65) Prior Publication Data

US 2007/0293129 A1 Dec. 20, 2007

(30) Foreign Application Priority Data

Dec. 10, 2004 (JP) ..... 2004-358859

(51) Int. Cl.
*B24B 29/00* (2006.01)

(52) U.S. Cl. ..... 451/288; 451/398; 451/402

(58) Field of Classification Search ..... 451/285, 451/287, 288, 397, 398, 402
See application file for complete search history.

(56) References Cited

U.S. PATENT DOCUMENTS 4,918,869 A 4/1990 Kitta
5,624,299 A * 4/1997 Shendon ..... 451/28
5,913,718 A 6/1999 Shendon
5,938,884 A 8/1999 Hoshizaki et al.
5,985,094 A 11/1999 Mosca
6,056,632 A 5/2000 Mitchel et al.

(Continued)

FOREIGN PATENT DOCUMENTS

EP 0 859 399 8/1998

(Continued)

OTHER PUBLICATIONS

Translation of the Chinese Office Action issued Sep. 26, 2008 in connection with Chinese Patent Application No. 200580042189X corresponding to the present U.S. application.

*Primary Examiner*—Eileen P. Morgan
(74) *Attorney, Agent, or Firm*—Wenderoth, Lind & Ponack L.L.P.

(57) ABSTRACT

A substrate holding device according to the present invention includes an elastic membrane to be brought into contact with a rear surface of a substrate, an attachment member for securing at least a portion of the elastic membrane, and a retainer ring for holding a peripheral portion of the substrate while in contact with the elastic membrane. The elastic membrane comprises at least one projecting portion, and the attachment member comprises at least one engagement portion engaging side surfaces of the at least one projecting portion of the elastic membrane. The elastic membrane further comprises bellows portions expandable in a pressing direction so as to allow the elastic membrane to press the substrate, and contractible along the pressing direction.

13 Claims, 7 Drawing Sheets

U.S. PATENT DOCUMENTS

| | | | | |
|---|---|---|---|---|
| 6,080,050 | A | 6/2000 | Chen et al. | |
| 6,106,379 | A | 8/2000 | Mosca | |
| 6,132,298 | A | 10/2000 | Zuniga et al. | |
| 6,159,079 | A | 12/2000 | Zuniga et al. | |
| 6,162,116 | A | 12/2000 | Zuniga et al. | |
| 6,183,354 | B1 | 2/2001 | Zuniga et al. | |
| 6,210,255 | B1 * | 4/2001 | Zuniga et al. | 451/41 |
| 6,244,942 | B1 | 6/2001 | Zuniga | |
| 6,277,010 | B1 | 8/2001 | Perlov et al. | |
| 6,277,014 | B1 | 8/2001 | Chen et al. | |
| 6,358,121 | B1 | 3/2002 | Zuniga | |
| 6,361,420 | B1 | 3/2002 | Zuniga et al. | |
| 6,406,361 | B1 * | 6/2002 | Zuniga et al. | 451/287 |
| 6,443,823 | B1 | 9/2002 | Tolles et al. | |
| 6,645,044 | B2 | 11/2003 | Zuniga | |
| 6,676,497 | B1 | 1/2004 | Chen et al. | |
| 6,857,945 | B1 | 2/2005 | Chen et al. | |
| 2002/0081955 | A1 | 6/2002 | Numoto | |
| 2002/0086624 | A1 * | 7/2002 | Zuniga et al. | 451/56 |
| 2002/0151251 | A1 * | 10/2002 | Zuniga | 451/5 |
| 2004/0005842 | A1 * | 1/2004 | Chen et al. | 451/41 |
| 2004/0067719 | A1 * | 4/2004 | Zuniga | 451/8 |
| 2004/0192173 | A1 * | 9/2004 | Zuniga et al. | 451/41 |
| 2005/0142993 | A1 | 6/2005 | Chen et al. | |
| 2006/0194519 | A1 * | 8/2006 | Fuhriman et al. | 451/41 |
| 2006/0199479 | A1 | 9/2006 | Togawa et al. | |
| 2007/0010181 | A1 * | 1/2007 | Spiegel | 451/402 |
| 2008/0166957 | A1 * | 7/2008 | Togawa et al. | 451/288 |

FOREIGN PATENT DOCUMENTS

| | | |
|---|---|---|
| EP | 1 066 924 | 1/2001 |
| EP | 1066924 | 1/2001 |
| EP | 1080841 | 3/2001 |
| JP | 2000-127026 | 5/2000 |
| JP | 2001-038604 | 2/2001 |
| JP | 2004-516644 | 6/2004 |
| JP | 2004-297029 | 10/2004 |
| WO | 02/07931 | 1/2002 |
| WO | 2004/070806 | 8/2004 |

* cited by examiner

SUBSTRATE HOLDING DEVICE AND POLISHING APPARATUS

TECHNICAL FIELD

The present invention relates to a polishing apparatus for polishing a substrate, such as a semiconductor wafer, to form a flat and mirror-finished surface thereon, and more particularly to a substrate holding device for pressing a substrate via an elastic membrane against a polishing surface of the polishing apparatus.

BACKGROUND ART

In recent years, semiconductor devices have become small in size and the structure of semiconductor elements have become more complicated. In addition, the layers in multilayer interconnects used for a logical system have increased in number. Accordingly, irregularities on a surface of a semiconductor device are likely to increase and step heights are also likely to increase. This is because, during a manufacturing process of the semiconductor device, a thin film is formed on the semiconductor device, then micromachining processes, such as patterning or forming holes, are performed on the semiconductor device, and these processes are repeated many times to form subsequent thin films on the semiconductor device.

When irregularities on the surface of the semiconductor device increase, the following problems arise. When a thin film is formed on the semiconductor device, the thickness of the film formed on the step portions is relatively small. Further, an open circuit may be caused by disconnection of interconnects, or a short circuit may be caused by insufficient insulation between interconnect layers. As a result, it is difficult to obtain good products, and the yield tends to be lowered. Even if a semiconductor device initially works normally, reliability of the semiconductor device is lowered after long-term use. Further, at a time of exposure during the lithography process, if an irradiation surface has irregularities, then a lens unit in an exposure system is locally unfocused. Therefore, if the irregularities on the surface of the semiconductor device increase, it becomes problematically difficult to form the fine pattern itself on the semiconductor device.

Thus, it becomes increasingly important in a manufacturing process of a semiconductor device to planarize the surface of the semiconductor device. One of the most important planarizing technologies is chemical mechanical polishing (CMP). The chemical mechanical polishing is performed using a polishing apparatus. Specifically, a substrate, such as a semiconductor wafer, is brought into sliding contact with a polishing surface while a polishing liquid containing abrasive particles such as silica ($SiO_2$) is supplied onto the polishing surface, so that the substrate is polished.

This kind of polishing apparatus comprises a polishing table having a polishing surface formed on a polishing pad, and a substrate holding device, which is called a top ring, for holding a semiconductor wafer. The polishing apparatus polishes a semiconductor wafer as follows. The substrate holding device holds the semiconductor wafer and presses the semiconductor wafer against the polishing surface at a certain pressure. In this state, the polishing table and the substrate holding device are moved relative to each other to bring the semiconductor wafer into sliding contact with the polishing surface, whereby the semiconductor wafer is polished to have a flat and mirror-finished surface.

In the above polishing apparatus, if the relative pressing force between the semiconductor wafer and the polishing surface of the polishing pad is not uniform over an entire surface of the semiconductor wafer during polishing, then the semiconductor wafer may be insufficiently polished or may be excessively polished at some portions depending on the pressing force applied to those portions of the semiconductor wafer. In order to avoid such a drawback, it has been attempted to form a substrate-holding surface of the substrate holding device with use of an elastic membrane made of elastic material such as rubber, and to apply fluid pressure such as air pressure to a backside surface of the elastic membrane so as to provide a uniform pressing force over the entire surface of the semiconductor wafer.

However, use of such an elastic membrane may meet the following problems. When the semiconductor wafer is being rotated, the elastic membrane is twisted and deformed. As a result, a polishing rate, i.e., a removal rate, at a peripheral portion (edge portion) of the semiconductor wafer is greatly lowered compared with other portions. Further, due to such twisting and deformation of the elastic membrane, a polishing profile may not be symmetrical, especially at the edge portion, about a center of the semiconductor wafer. Furthermore, individual differences of elastic membranes and retainer rings, which hold a peripheral portion of the semiconductor wafer, may cause a variation in polishing profiles among the top rings.

SUMMARY OF THE INVENTION

The present invention has been made in view of the above drawbacks. It is, therefore, an object of the present invention to provide a substrate holding device and a polishing apparatus which can prevent twisting and deformation of an elastic membrane attached to a substrate-holding surface to thereby achieve high-quality polishing.

In order to achieve the above objects, according to an aspect of the present invention, there is provided a substrate holding device comprising an elastic membrane that is to be brought into contact with a rear surface of a substrate, an attachment member for securing at least a portion of the elastic membrane, and a retainer ring for holding a peripheral portion of the substrate while the substrate is in contact with the elastic membrane. The elastic membrane includes at least one projecting portion, and the attachment member includes at least one engagement portion engaging the at least one projecting portion of the elastic membrane.

In a preferred aspect of the present invention, the at least one projecting portion projects radially inwardly of the elastic membrane.

In a preferred aspect of the present invention, the at least one projecting portion comprises plural projecting portions, and the at least one engagement portion comprises plural engagement portions.

In a preferred aspect of the present invention, the plural engagement portions are arranged symmetrically about a center of the substrate.

In a preferred aspect of the present invention, the at least one engagement portion has a thickness larger than or equal to a thickness of the elastic membrane to be brought into contact with the rear surface of the substrate.

With these structures, when the elastic membrane is about to be twisted due to rotation of the substrate holding device, the projecting portion(s) of the elastic membrane engages the engagement portion(s) of the attachment member to thereby suppress twisting of the elastic membrane to a minimal level.

Therefore, a polishing profile can be appropriately controlled, and high-quality polishing can be achieved.

According to another aspect of the present invention, there is provided a substrate holding device comprising an elastic membrane that is to be brought into contact with a rear surface of a substrate, an attachment member for securing at least a portion of the elastic membrane, and a retainer ring for holding a peripheral portion of the substrate while the substrate is in contact with the elastic membrane. The elastic membrane comprises a circumferential membrane having a projecting portion. The projecting portion projects radially inwardly from a circumferential edge of the elastic membrane and extends entirely along the circumferential edge of the elastic membrane.

With this structure, the projecting portion, projecting radially inwardly from the circumferential edge of the elastic membrane and extending entirely along the circumferential edge in its circumferential direction, can prevent the elastic membrane from being deformed in a radial direction thereof. Therefore, for example, it is possible to prevent the circumferential edge of the elastic membrane from expanding in the radial direction to contact the retainer ring, and therefore prevent the elastic membrane from being damaged. The projecting portion, extending entirely along the circumferential edge of the elastic membrane, may be made of a different material (e.g., stainless steel or resin) in order to enhance strength, or may be made harder than other portions.

In a preferred aspect of the present invention, the elastic membrane comprises a bellows portion which is expandable in a pressing direction so as to allow the elastic membrane to press the substrate against a polishing surface and is contractible along the pressing direction.

The above-mentioned projecting portion formed on the elastic membrane may cause obstruction to expansion and contraction of the elastic membrane in the pressing direction. However, the bellows portion formed in the elastic membrane can expand and contract to thereby compensate such obstruction of expansion and contraction of the elastic membrane. Accordingly, the circumferential edge of the elastic membrane can flexibly follow the polishing surface.

The elastic membrane to be brought into contact with the rear surface of the substrate may be made thick. This thick portion of the elastic membrane contacting the substrate can prevent formation of surges running in a radial direction of the elastic membrane. This contacting portion of the elastic membrane is preferably thicker than the bellows portion. The bellows portion is made thin in order to enhance a stretching property thereof, and a portion contacting the rear surface of the substrate is made thick in order to prevent twisting of the elastic membrane. The engagement portion is preferably thicker than the bellows portion in order to prevent twisting of the elastic membrane. Because the largest moment acts on an outermost circumferential portion, this portion is preferably thicker than the portion contacting the rear surface of the substrate.

According to another aspect of the present invention, there is provided a substrate holding device comprising an elastic membrane that is to be brought into contact with a rear surface of a substrate, an attachment member for securing at least a portion of the elastic membrane, and a retainer ring for holding a peripheral portion of the substrate while the substrate is in contact with the elastic membrane. The elastic membrane includes a circumferential membrane having plural cylindrical surfaces which are concentrically arranged and extend toward the substrate, and a bottom-surface membrane to be brought into contact with the substrate and configured to intersect with the circumferential membrane at substantially a right angle.

Because the bottom-surface membrane and the circumferential membrane are configured to intersect at substantially a right angle, the circumferential edge of the elastic membrane can be brought into sufficient contact with the peripheral portion of the semiconductor wafer to thereby press it. In this case, the elastic membrane is preferably made of soft material having low hardness.

According to another aspect of the present invention, there is provided a polishing apparatus comprising a polishing table having a polishing surface, and the above substrate holding device. In this polishing apparatus, the substrate holding device is operable to hold a substrate and press the substrate against the polishing surface to thereby polish the substrate.

With this structure, it is possible to prevent twisting and deformation of the elastic membrane attached to a substrate-holding surface of the substrate holding device to thereby achieve high quality polishing.

DETAILED DESCRIPTION OF THE INVENTION

Figure 1:
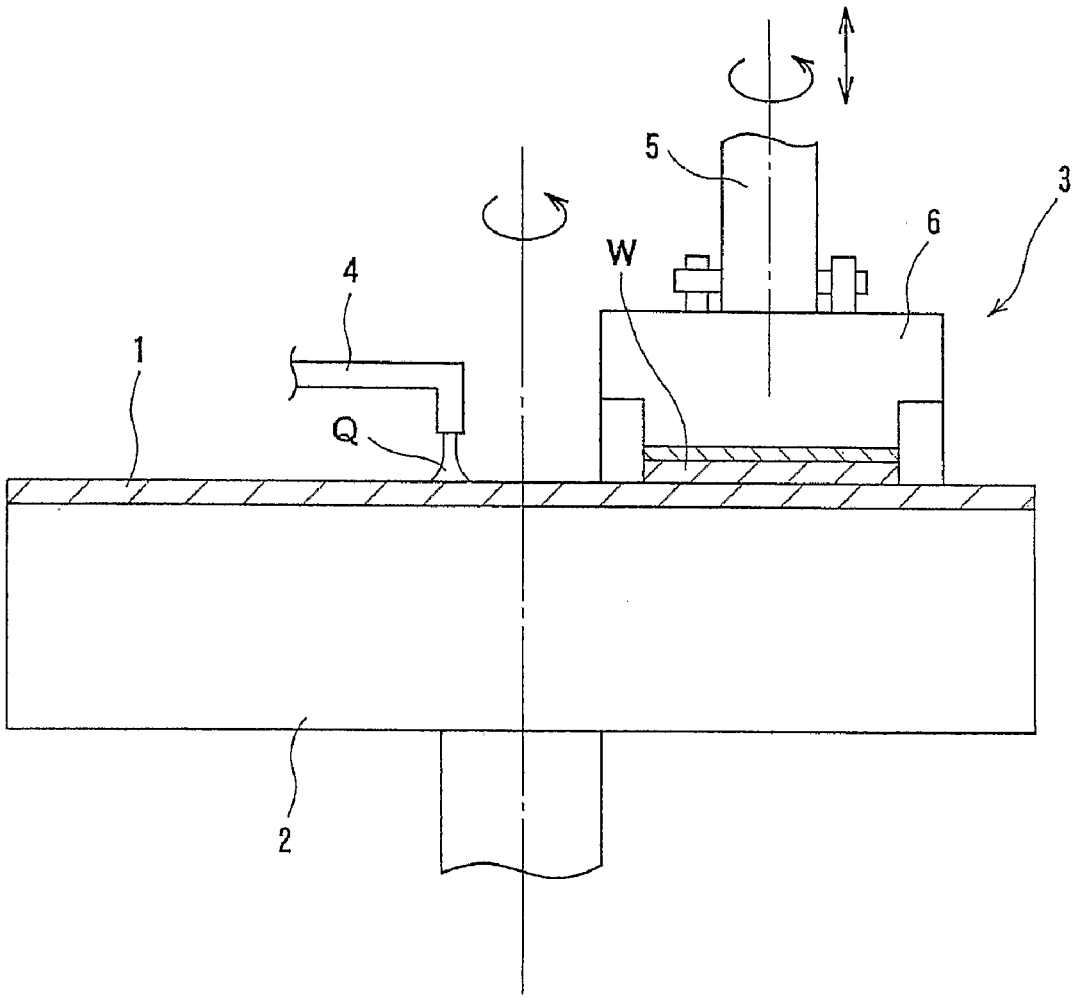
FIG. 1 is a schematic view showing a polishing apparatus according to a first embodiment of the present invention.

A polishing apparatus including a substrate holding device according to embodiments of the present invention will be described below in detail with reference to FIGS. 1 through 7. In FIGS. 1 through 7, identical or corresponding elements are denoted by the same reference numerals and will not be repetitively described.

FIG. 1 is a schematic view showing a polishing apparatus including a substrate holding device according to a first embodiment of the present invention. As shown in FIG. 1, the polishing apparatus comprises a polishing table 2 having a polishing pad 1 attached to an upper surface of the polishing table 2, and a top ring 3 serving as a substrate holding device for holding a substrate such as a semiconductor wafer W and pressing it against the polishing pad 1 on the polishing table 2. A polishing liquid supply nozzle 4 is provided above the polishing table 2 so that a polishing liquid Q is supplied onto the polishing pad 1 through the polishing liquid supply nozzle 4. The top ring 3 comprises a top ring shaft 5, which is rotatable and vertically movable, and a top ring body 6 coupled to the top ring shaft 5. In this embodiment, an upper surface of the polishing pad 1 serves as a polishing surface.

When polishing the semiconductor wafer W, the polishing table 2 and the top ring 3 are independently rotated, and the top ring 3 presses the semiconductor wafer W against the polishing pad 1 on the polishing table 2 at a predetermined pressure, while the polishing liquid Q is being supplied onto the polishing pad 1 through the polishing liquid supply nozzle 4. During polishing, a surface, to be polished, of the semiconductor wafer W and the polishing pad 1 are in sliding contact with each other, whereby the surface of the semiconductor wafer W is polished to a flat and mirror finish.

Figure 2:
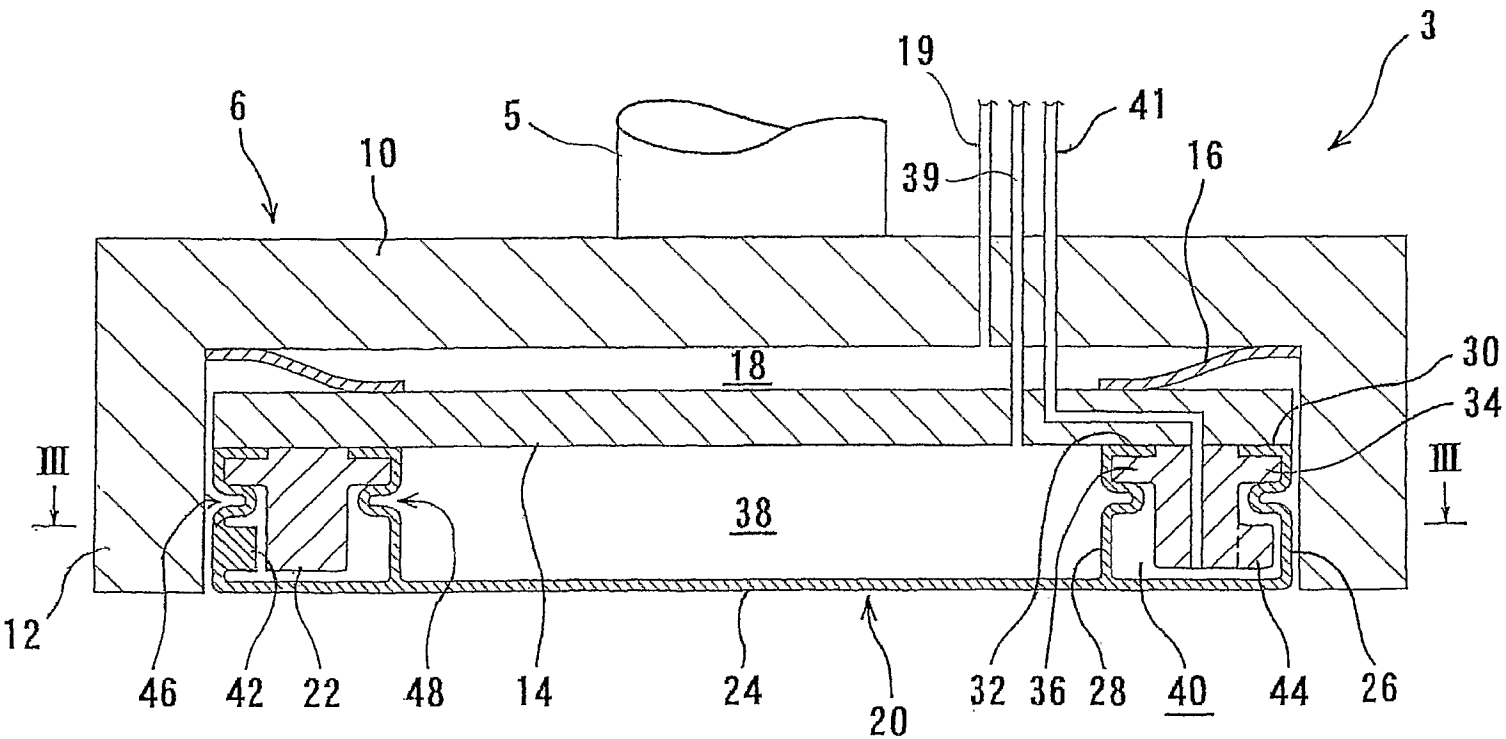
FIG. 2 is a vertical cross-sectional view showing a top ring of the polishing apparatus shown in FIG. 1.
Figure 3:
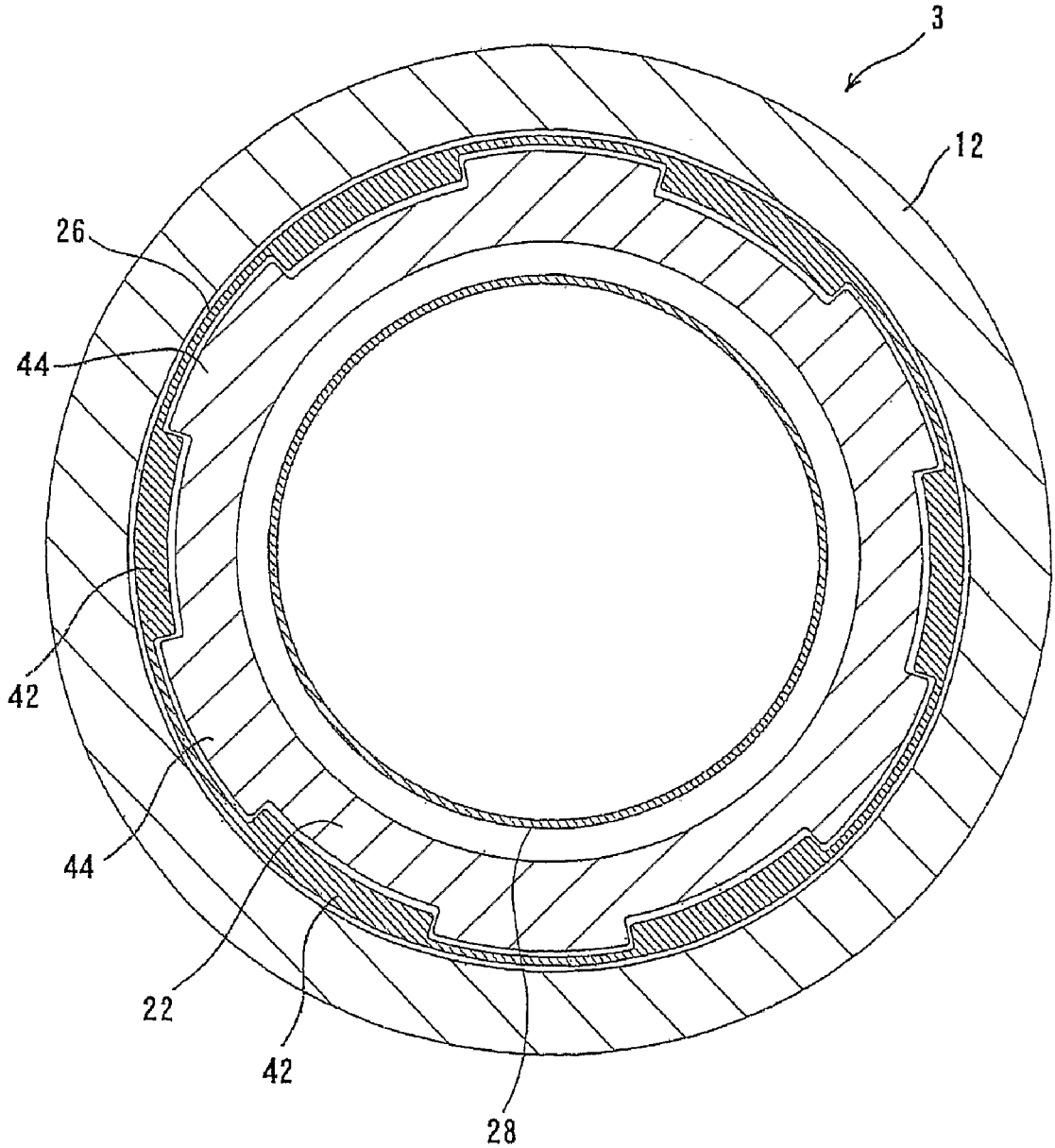
FIG. 3 is a cross sectional view taken along line III-III shown in FIG. 2.

FIG. 2 is a vertical cross-sectional view showing details of the top ring 3 shown in FIG. 1, and FIG. 3 is a cross sectional view taken along line III-III shown in FIG. 2. As shown in FIG. 2, the top ring body 6 of the top ring 3 comprises a disk section 10 coupled to the top ring shaft 5, and a retainer ring section 12 configured to hold a peripheral portion of the semiconductor wafer. A vertically movable member 14 is housed in a space defined by the disk section 10 and the retainer ring section 12. The vertically movable member 14 is coupled to the top ring body 6 via an annular elastic sheet 16.

The top ring body 6, the vertically movable member 14, and the elastic sheet 16 define a pressure chamber 18 inside of these components. The pressure chamber 18 is connected to a fluid supply source (not shown) through a fluid passage 19. A regulator (not shown) is provided in the fluid passage 19 so that the pressure of fluid to be supplied to the pressure chamber 18 can be adjusted by the regulator. This arrangement can control pressure in the pressure chamber 18, and can thus move the vertically movable member 14 in the vertical direction.

An elastic membrane 20 is attached to a lower surface of the vertically movable member 14 by an attachment member 22. The elastic membrane 20 is provided so as to cover the lower surface of the vertically movable member 14, and is configured to come into direct contact with a rear surface of the semiconductor wafer. In this specification, the rear surface of the semiconductor wafer means a surface opposite to a surface to be polished. The elastic membrane 20 is made of highly strong and durable rubber material such as ethylene propylene rubber (EPDM), polyurethane rubber, or silicone rubber.

As shown in FIG. 2, the elastic membrane 20 comprises a bottom-surface membrane 24 to be brought into contact with the rear surface of the semiconductor wafer, a first circumferential membrane 26 extending upwardly from a circumferential edge of the bottom-surface membrane 24, and a second circumferential membrane 28 positioned radially inwardly of the first circumferential membrane 26 and extending upwardly from the bottom-surface membrane 24. A radially inwardly extending portion 30 is formed on an upper edge portion of the circumferential membrane 26, and a radially outwardly extending portion 32 is formed on an upper edge portion of the circumferential membrane 28. The attachment member 22 has base portions 34 and 36 which press the extending portions 30 and 32 of the elastic membrane 20 against the vertically movable member 14 so as to secure the extending portions 30 and 32.

The bottom-surface membrane 24, the circumferential membrane 28, and the vertically movable member 14 define a pressure chamber 38 inside of these parts, and the pressure chamber 38 is connected to the fluid supply source through a fluid passage 39. A regulator (not shown) is also provided in the fluid passage 39 so that pressure of fluid to be supplied to the pressure chamber 38 can be adjusted by the regulator. With this arrangement, by adjusting the pressure of fluid to be supplied the pressure chamber 38, pressure in the pressure chamber 38 can be controlled. Accordingly, a pressing force, which is applied from the bottom-surface membrane 24 to a portion of the semiconductor wafer underneath the pressure chamber 38, can be adjusted.

The bottom-surface membrane 24, the circumferential membrane 28, the circumferential membrane 26, and the vertically movable member 14 define a pressure chamber 40 inside of these parts, and the pressure chamber 40 is connected to the fluid supply source through a fluid passage 41. A regulator (not shown) is provided in the fluid passage 41 so that pressure of fluid to be supplied to the pressure chamber 40 can be adjusted by the regulator. With this arrangement, by adjusting pressure of fluid to be supplied the pressure chamber 40, pressure in the pressure chamber 40 can be controlled. Accordingly, a pressing force, which is applied from the bottom-surface membrane 24 to a portion of the semiconductor wafer underneath the pressure chamber 40, can be adjusted.

According to this embodiment, the pressures in the pressure chamber 38 and the pressure chamber 40 are independently controlled, so that a pressing force applied to a portion of the semiconductor wafer underneath the pressure chamber 38 and the pressing force applied to a portion of the semiconductor wafer underneath the pressure chamber 40 can be independently adjusted. Therefore, a polishing rate (i.e., removal rate) can be adjusted at the peripheral portion of the semiconductor wafer and a portion located radially inwardly of the peripheral portion. In this manner, the polishing profile of the semiconductor wafer can be controlled.

As shown in FIG. 2, block-like projecting portions 42 are provided on the circumferential membrane 26 so as to project radially inwardly from a circumferential edge of the elastic membrane 20. In addition, as shown in FIGS. 2 and 3, engagement portions 44, which engage side surfaces of the projecting portions 42, are provided on a lower portion of the attachment member 22. It is preferable that each of the engagement portions 44 has a thickness larger than or equal to a thickness of the bottom-surface membrane 24. With this arrangement, when the elastic membrane 20 is about to be twisted due to rotation of the top ring 3, the projecting portions 42 of the elastic membrane 20 engage the engagement portions 44 of the attachment member 22 to thereby suppress twisting of the elastic membrane 20 to a minimal level. Therefore, a polishing profile can be appropriately controlled, and high-quality polishing can be achieved.

Although six projecting portions 42 and six engagement portions 44 are alternately arranged at equal intervals in the example shown in FIG. 3, the number of projecting portions 42 and engagement portions 44 is not limited to this example. Additionally, the size of the projecting portions 42 and the engagement portions 44 is not limited to this example shown in FIGS. 2 and 3. Furthermore, the projecting portions 42 may be formed integrally with the circumferential membrane 26, or may be a different material attached to the circumferential membrane 26. It is preferable that the projecting portions 42 and the engagement portions 44 are arranged symmetrically about a center of the semiconductor wafer, i.e., a center of the retainer ring section 12, so as to receive equal forces.

As shown in FIG. 2, the circumferential membrane 26 has a bellows portion 46 positioned below the base portion 34 of the attachment member 22, and the circumferential membrane 28 has a bellows portion 48 positioned below the base portion 36 of the attachment member 22. These bellows portions 46 and 48 allow the circumferential membrane 26 and the circumferential membrane 28 to expand in a direction such that the elastic membrane 20 presses the semiconductor wafer against the polishing pad 1, i.e., in a pressing direction.

The above-mentioned block-like projecting portion 42 formed on the circumferential membrane 26 may cause obstruction to expansion and contraction of the circumferential membrane 26 of the elastic membrane 20 in the pressing direction. However, the bellows portions 46 and 48 formed in the circumferential membrane 26 and the circumferential membrane 28 can expand and contract to thereby compensate such obstruction of expansion and contraction of the circumferential membrane 26. Accordingly, a circumferential edge of the elastic membrane 20 can flexibly follow the polishing surface of the polishing pad 1.

Figure 4:
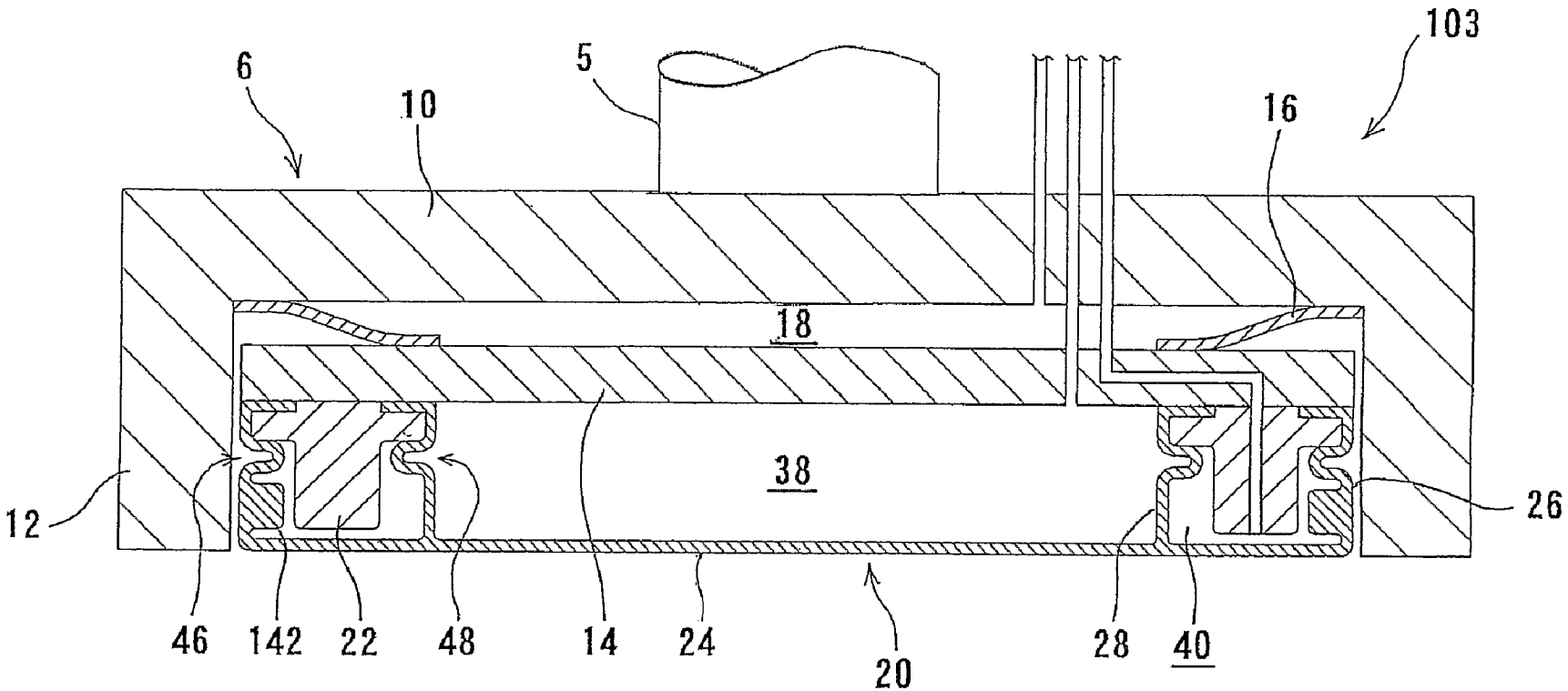
FIG. 4 is a vertical cross-sectional view showing a top ring according to a second embodiment of the present invention.

FIG. 4 is a vertical cross-sectional view showing a top ring 103 according to a second embodiment of the present invention. A block-like projecting portion 142 is provided on the circumferential membrane 26 of the elastic membrane 20 of the top ring 103. The projecting portion 142 projects radially inwardly from a circumferential edge of the elastic membrane 20, and extends entirely along the circumferential membrane 26 in its circumferential direction. Therefore, the attachment member 22 of this embodiment does not have the engagement portions 44 of the first embodiment. Other structures are the same as the first embodiment.

The projecting portion 142, projecting radially inwardly from the circumferential membrane 26 of the elastic membrane 20 and extending entirely along the circumferential membrane 26, can prevent the circumferential membrane 26 from being deformed in a radial direction thereof. Therefore, it is possible to prevent the circumferential membrane 26 from expanding in the radial direction to contact the retainer ring section 12 during rotation of the top ring 103, and therefore prevent the circumferential membrane 26 from being damaged.

Figure 5:
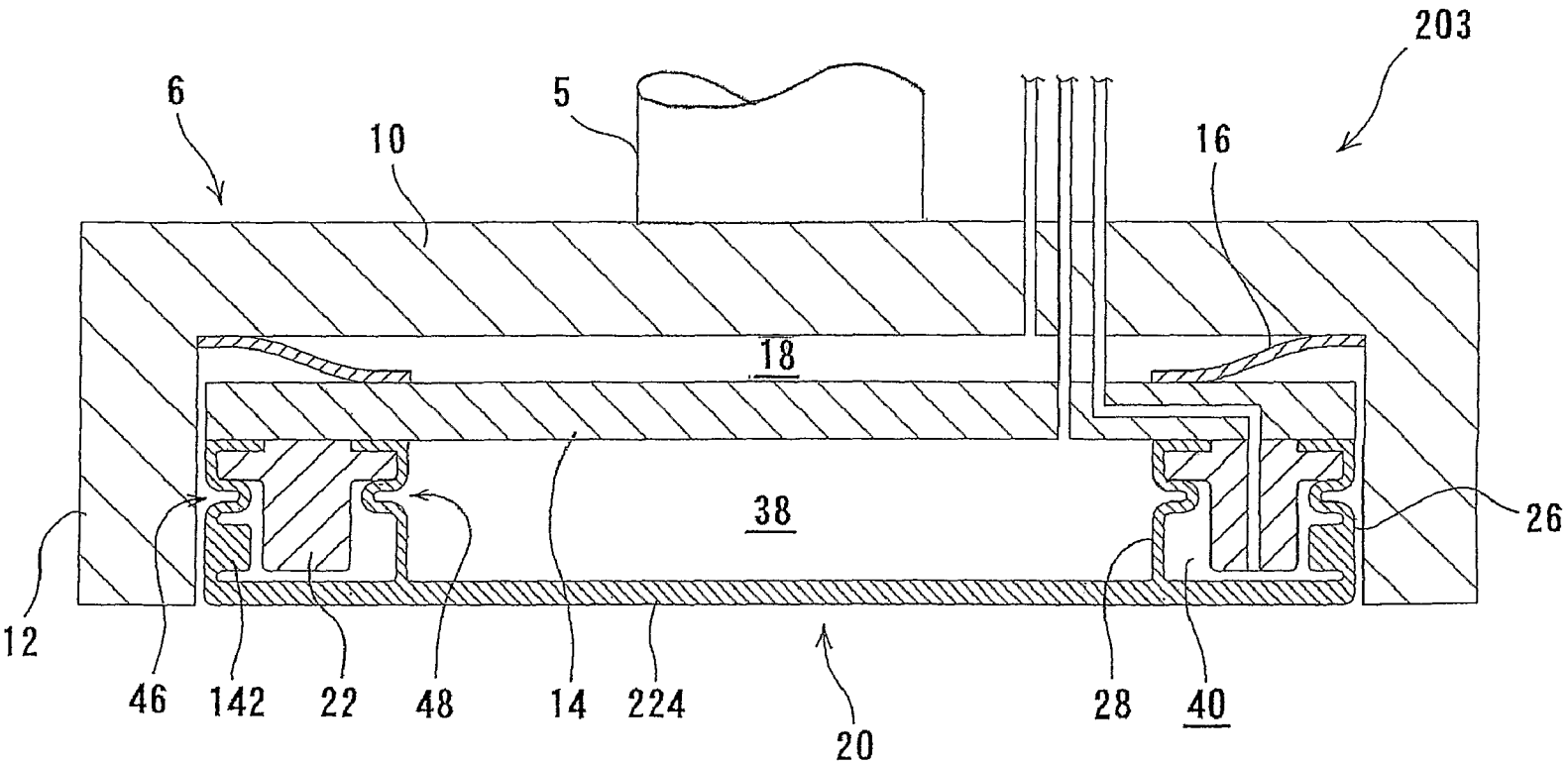
FIG. 5 is a vertical cross-sectional view showing a top ring according to a third embodiment of the present invention.

FIG. 5 is a vertical cross-sectional view showing a top ring 203 according to a third embodiment of the present invention. The top ring 203 is an improvement of the top ring 103 of the second embodiment. Specifically, a bottom-surface membrane 224 of the elastic membrane 20 is thicker than the bottom-surface membrane 24 of the second embodiment, and is thicker than the bellows portions 46 and 48. Specific thickness of the bottom-surface membrane 224 contacting the semiconductor wafer is preferably in the range of 1.2 to 2.0 mm. According to this embodiment, the thick bottom-surface membrane 224 can prevent formation of surges running in a radial direction of the elastic membrane 20.

Figure 6:
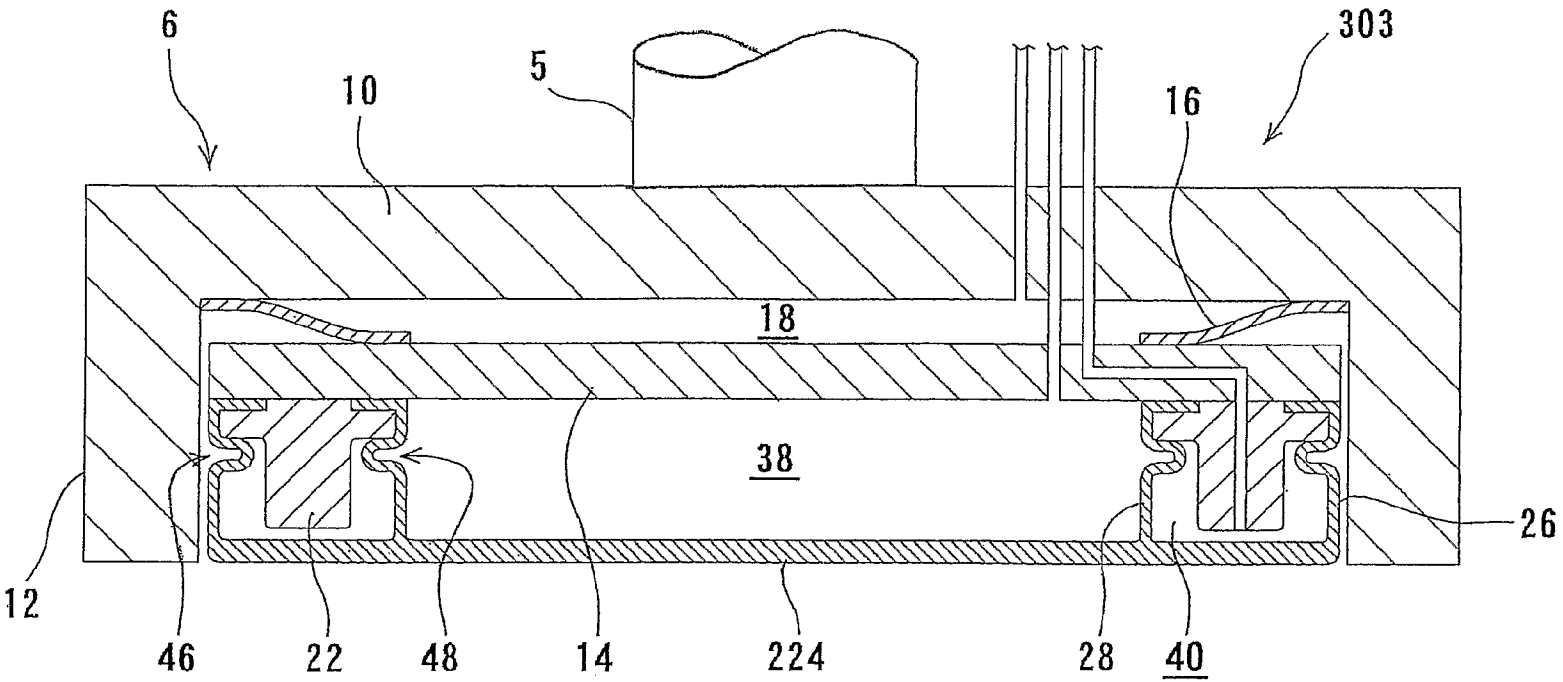
FIG. 6 is a vertical cross-sectional view showing a top ring according to a fourth embodiment of the present invention.

FIG. 6 is a vertical cross-sectional view showing a top ring 303 according to a fourth embodiment of the present invention. In this embodiment, the projecting portions 42 of the first embodiment and the projecting portion 142 of the second and third embodiments are not provided on the circumferential membrane 26 of the elastic membrane 20, and the bottom-surface membrane 224 contacting the semiconductor wafer is made thick as with the third embodiment.

Figure 7:
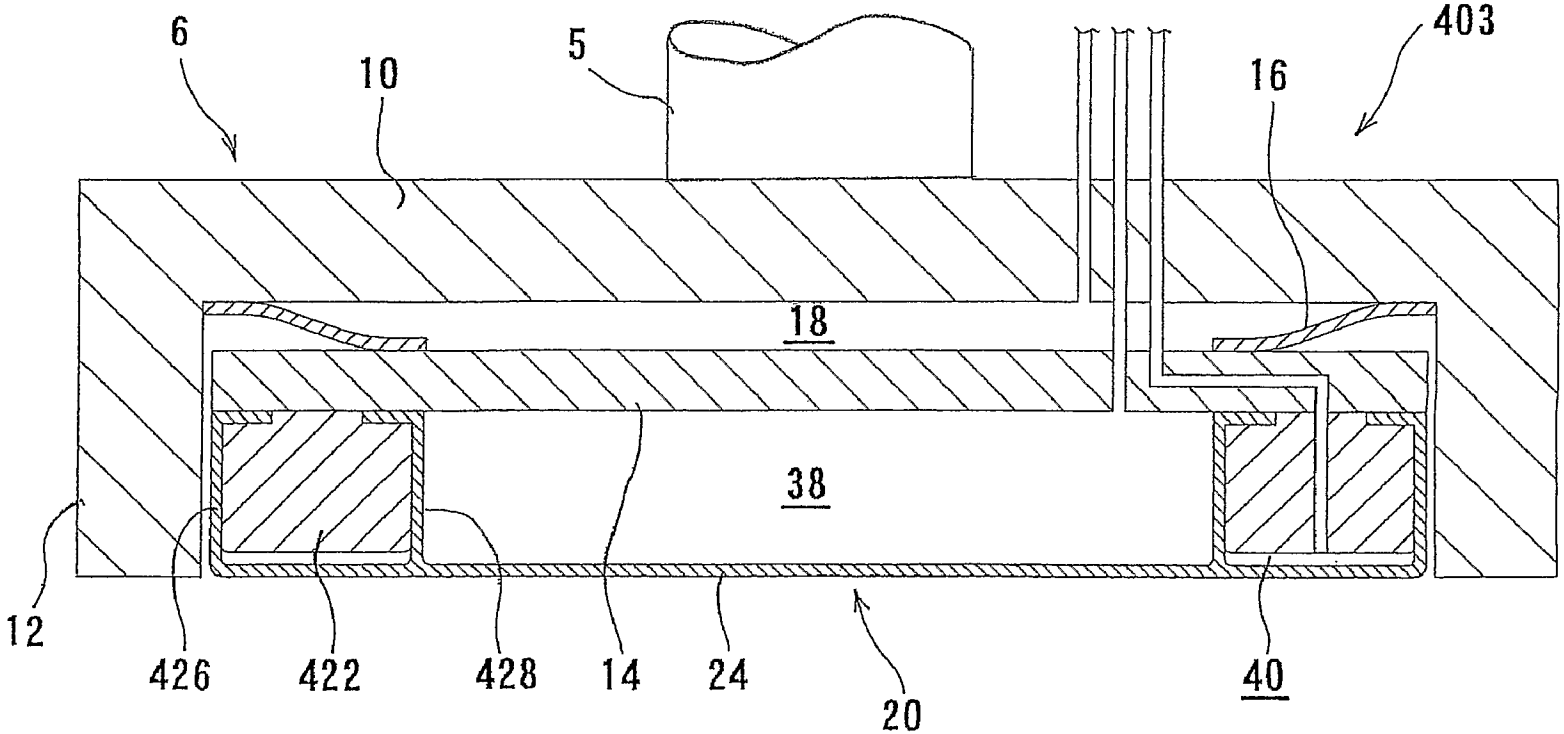
FIG. 7 is a vertical cross-sectional view showing a top ring according to a fifth embodiment of the present invention.

FIG. 7 is a vertical cross-sectional view showing a top ring 403 according to a fifth embodiment of the present invention. An attachment member 422 of this embodiment has a ring shape. An entire inner circumferential surface of the attachment member 422 is in contact with a circumferential membrane 428 of the elastic membrane 20, and an entire outer circumferential surface of the attachment member 422 is in contact with a circumferential membrane 426 of the elastic membrane 20. In this embodiment, the elastic membrane 20 does not have the bellows portions 46 and 48 of the above embodiments, and the circumferential membrane 426 of the elastic membrane 20 is formed by a cylindrical surface extending in the pressing direction.

In the previously mentioned embodiments, the bellows portions formed in the elastic membrane extend to allow the elastic membrane to press the peripheral portion of the semiconductor wafer. On the other hand, the elastic membrane 20 of this embodiment does not have the bellows portions. Consequently, the elastic membrane 20 may not expand enough to appropriately press the peripheral portion of the semiconductor wafer. In view of this, the bottom-surface membrane 24 and the circumferential membrane 426 of the elastic membrane 20 are configured to intersect at substantially a right angle, so that the circumferential edge of the elastic membrane 20 can sufficiently be brought into contact with the peripheral portion of the semiconductor wafer to thereby press it. In this embodiment, the elastic membrane 20 is preferably made of soft material having low hardness.

In the above-mentioned embodiments, some portions, such as an outer circumferential portion and its nearby portion, of the attachment members 22 and 422, and/or an inner circumferential portion of the retainer ring section 12 may be made of low frictional material such as fluorine resin, because these portions are likely to come into sliding contact with the circumferential membranes 26 and 426 and the circumferential membranes 28 and 428. Further, in order to lower surface friction, the circumferential membranes 26 and 426 and the circumferential membranes 28 and 428 may be impregnated with silicon, fluorine, or their compounds. Such structures can prevent the elastic membrane 20 from being twisted during polishing, and can allow the circumferential membranes 26 and 426 and the circumferential membranes 28 and 428 to smoothly move with respect to the vertically movable member 14 and the retainer ring section 12. Accordingly, a polishing profile can be appropriately controlled, and hence high quality polishing can be achieved.

Although the polishing pad forms the polishing surface in the above embodiments, the present invention is not limited to such a structure. For example, the polishing surface may be constituted by a fixed abrasive. The fixed abrasive is a plate-like polishing tool comprising abrasive particles fixed by a binder. A polishing process using the fixed abrasive is performed by abrasive particles that are self-generated from the fixed abrasive. The fixed abrasive comprises abrasive particles, a binder, and pores. For example, cerium dioxide ($CeO_2$) having an average particle diameter of at most 0.5 μm is used as the abrasive particles, and epoxy resin is used as the binder. Such fixed abrasive forms a hard polishing surface. Examples of the fixed abrasive include, other than the above plate-like polishing tool, a fixed abrasive pad having a two-layer structure formed by a thin layer of a fixed abrasive and an elastic polishing pad attached to a lower surface of the thin layer of the fixed abrasive.

Although certain preferred embodiments of the present invention have been described, it should be understood that the present invention is not limited to the above embodiments, and various changes and modifications may be made without departing from the scope of the technical concept of the present invention.

INDUSTRIAL APPLICABILITY

The present invention is applicable to a substrate holding device for pressing a substrate via an elastic membrane against a polishing surface of a polishing apparatus.

The invention claimed is:

1. A substrate holding device for pressing a substrate against a polishing surface, said substrate holding device comprising:

a top ring body;

a vertically moveable member being moveable independently from said top ring body;

an elastic membrane arranged to be brought into contact with a rear surface of the substrate, said elastic membrane having a plurality of projecting portions;

an attachment member securing at least a portion of said elastic membrane to said vertically moveable member; and a plurality of engagement portions provided on said attachment member, each engagement portion in said plurality of engagement portions being configured to engage an adjacent projecting portion in said plurality of projecting portions so as to prevent twisting of said elastic membrane, wherein said projecting portions and said engagement portions are arranged so as to alternate and said projecting portions and said engagement portions are symmetrically arranged about a center of said elastic membrane.

2. The substrate holding device according to claim 1, wherein said projecting portions project radially inwardly of said elastic membrane.

3. The substrate holding device according to claim 1, wherein each engagement portion of said plurality of engagement portions is provided on a lower portion of said attachment member, and each engagement portion of said plurality of engagement portions has a thickness larger than or equal to a thickness of said elastic membrane.

4. The substrate holding device according to claim 1, wherein said elastic membrane comprises a bellows portion which is expandable and contractible along a pressing direction in which the substrate is pressed against the polishing surface.

5. The substrate holding device according to claim 4, wherein said elastic membrane has a bottom-surface membrane configured to contact the substrate, and said bottom-surface membrane is thicker than said bellows portion in the pressing direction.

6. The substrate holding device according to claim 1, wherein each engagement portion in said plurality of engagement portions is a first protrusion extending radially outwardly and each projecting portion in said plurality of projecting portions is a second protrusion extending radially inwardly.

7. The substrate holding device according to claim 1, wherein each engagement portion in said plurality of engagement portions includes a first radially extending surface facing in a first circumferential direction and each projecting portion in said plurality of projecting portions includes a second radially extending surface facing in a second circumferential direction, the second circumferential direction being opposite the first circumferential direction, and said first surface for each engagement portion being configured to engage an adjacent second surface so as to prevent twisting of said elastic membrane.

8. A substrate holding device for pressing a substrate against a polishing surface, said substrate holding device comprising:

a top ring body;

a vertically moveable member being moveable independently from said top ring body;

an elastic membrane arranged to be brought into contact with a rear surface of the substrate, said elastic membrane including a circumferential membrane having a bellows portion being expandable and contractible in a pressing direction in which the substrate is pressed against the polishing surface, said bellows portion being positioned below said vertically moveable member; and an attachment member securing at least a portion of said elastic membrane to said vertically moveable member, said attachment member having a plurality of engagement portions arranged about a center of said attachment member;

wherein said elastic membrane includes a plurality of projecting portions, wherein the projecting portions and engagement portions are alternately arranged around the circumference of the elastic membrane such that the engagement portions engage adjacent projecting portions and extends entirely along said circumferential membrane so as to prevent said circumferential membrane from being deformed in a radial direction.

9. The substrate holding device according to claim 8, wherein said elastic membrane has a bottom-surface membrane configured to contact the substrate, and said bottom-surface membrane is thicker than said bellows portion in the pressing direction.

10. The substrate holding device according to claim 8, wherein said projecting portions are constructed and arranged so as to prevent said circumferential membrane from expanding in a radial direction to contact a retainer ring.

11. A substrate holding device for pressing a substrate against a polishing surface, said substrate holding device comprising:

a top ring body;

a vertically moveable member being moveable independently from said top ring body;

an elastic membrane arranged to be brought into contact with a rear surface of a substrate, said elastic membrane including a circumferential membrane having a bellows portion which is expandable and contractible in a pressing direction in which the substrate is pressed against the polishing surface, said bellows portion being shaped so as to enable said elastic membrane to flexibly adjust such that said elastic membrane continuously contacts the polishing surface during polishing of the substrate, said bellows portion being positioned below said vertically moveable member; and an attachment member securing at least a portion of said elastic membrane to said vertically moveable member; wherein the elastic membrane has a plurality of projecting portions and the attachment member has a plurality of engagement portions, and the projecting portions and engagement portions are alternately arranged around the circumference of the elastic membrane such that the engagement portions engage adjacent projecting portions.

12. The substrate holding device according to claim 11, wherein said projecting portions extend along said circumferential membrane so as to prevent said circumferential membrane from being deformed in a radial direction.

13. The substrate holding device according to claim 11, wherein said top ring body includes a retainer ring configured to hold a peripheral portion of the substrate while the substrate is in contact with said elastic membrane.

* * * * *

UNITED STATES PATENT AND TRADEMARK OFFICE

CERTIFICATE OF CORRECTION

PATENT NO. : 7,635,292 B2
APPLICATION NO. : 11/791218
DATED : December 22, 2009
INVENTOR(S) : Tetsuji Togawa et al.

It is certified that error appears in the above-identified patent and that said Letters Patent is hereby corrected as shown below:

In column 10, claim 8, line 9, "includes a plurality of" should read --includes a circumferential membrane and a plurality of--.

In column 10, claim 8, lines 13-15, "portions and extends entirely along said circumferential membrane" should read --portions--.

Signed and Sealed this

Ninth Day of March, 2010

David J. Kappos

David J. Kappos
*Director of the United States Patent and Trademark Office*